US009752346B2

(12) United States Patent
Chen

(10) Patent No.: US 9,752,346 B2
(45) Date of Patent: Sep. 5, 2017

(54) TENT ASSEMBLY

(71) Applicant: SPORTSMAN CORPORATION, New Taipei (TW)

(72) Inventor: Jack Chen, New Taipei (TW)

(73) Assignee: Sportsman Corporation, New Taipei (TW)

( * ) Notice: Subject to any disclaimer, the term of this patent is extended or adjusted under 35 U.S.C. 154(b) by 0 days.

(21) Appl. No.: 15/071,276

(22) Filed: Mar. 16, 2016

(65) Prior Publication Data

US 2016/0348394 A1 Dec. 1, 2016

(30) Foreign Application Priority Data

May 28, 2015 (TW) ..... 104117262 A

(51) Int. Cl.
*E04H 15/48* (2006.01)
*E04H 15/42* (2006.01)
*E04H 15/64* (2006.01)

(52) U.S. Cl.
CPC ..... *E04H 15/48* (2013.01); *E04H 15/42* (2013.01); *E04H 15/64* (2013.01)

(58) Field of Classification Search
CPC ..... E04H 15/64; E04H 15/48; E04H 15/42
USPC ..... 135/119, 156
See application file for complete search history.

(56) References Cited

U.S. PATENT DOCUMENTS 3,929,146 A * 12/1975 Maiken ..... E04H 15/28 135/117
4,202,363 A * 5/1980 Watts ..... E04H 15/28 135/126
5,002,083 A * 3/1991 Kim ..... E04H 15/425 135/119
5,261,436 A * 11/1993 Funk ..... E04H 15/42 135/119
5,884,646 A * 3/1999 Ju ..... E04H 15/42 135/124
6,776,179 B1 * 8/2004 Chen ..... E04H 15/42 135/135
7,823,600 B2 * 11/2010 Laakso ..... E04H 15/425 135/115

(Continued)

FOREIGN PATENT DOCUMENTS

CN 202689675 U 1/2013
EP 1975346 A1 10/2008

(Continued)

*Primary Examiner* — Noah Chandler Hawk
(74) *Attorney, Agent, or Firm* — Alan D. Kamrath; Kamrath IP Lawfirm, P.A.

(57) ABSTRACT

A tent assembly has a supporting frame and a rainfly. The supporting frame has a top base and multiple supporting rod units. Each supporting rod unit has a top rod, a first joint, a middle rod, and two hooks. The first joint is connected with the top rod and has a pivotal center. The middle rod is connected with the first joint. The hooks respectively have an end pivotally connected with the first joint respectively at positions away from the pivotal center of the first joint. The rainfly is connected with the supporting frame and has multiple connection units. Each connection unit has multiple connection ropes and at least one elastic belt. The at least one elastic belt is mounted around the hooks of a corresponding one of the supporting rod units.

11 Claims, 8 Drawing Sheets

(56) References Cited

U.S. PATENT DOCUMENTS

| | | | | |
|---|---|---|---|---|
| 8,763,621 | B2 * | 7/2014 | Jin | E04H 15/44 135/115 |
| 2007/0051399 | A1 * | 3/2007 | Jung | E04H 15/48 135/135 |
| 2011/0297201 | A1 * | 12/2011 | Chen | E04H 15/42 135/144 |
| 2015/0167346 | A1 * | 6/2015 | Li | E04H 15/64 135/119 |

FOREIGN PATENT DOCUMENTS

| | | | | |
|---|---|---|---|---|
| NL | 91013333 | A | 1/1992 | |
| NL | EP 0704586 | A1 * | 4/1996 | E04H 15/40 |
| TW | EP 1975347 | A1 * | 10/2008 | E04H 15/42 |
| WO | WO2010060303 | A1 | 6/2010 | |

* cited by examiner

TENT ASSEMBLY

BACKGROUND OF THE INVENTION

1. Field of the Invention

The present invention relates to a tent assembly and, more particularly, to a tent assembly that can be constructed and deconstructed easily.

2. Description of Related Art

A tent can be easily built, disassembled, and transported and is a convenient tool for camping and accommodation. A conventional tent substantially comprises a supporting frame, a rainfly, and multiple supporting ropes. The supporting frame comprises multiple rods to support the rainfly, and the supporting ropes are connected between the rainfly and the ground to support the tent on the ground.

With reference to FIGS. 7 and 8, the rainfly 40 of the conventional tent can be expanded to connect with and be supported by the supporting frame, and the supporting frame provides a supporting effect to the rainfly 40 in the expanded condition. The supporting frame of the conventional tent substantially comprises multiple top rods 31, multiple joints 30, multiple bottom rods 33, multiple hooks 34, and multiple elastic belts 35. The hooks 34 are respectively connected pivotally with the joints 30 at the pivotal centers of the joints 30, and the elastic belts 35 are connected with the hooks 34 respectively. However, the elastic belts 35 are still expanded even when the supporting frame is under a folded condition, so the elastic belts 35 easily develop elastic fatigue. Accordingly, the supporting frame cannot provide a sufficient supporting effect to the rainfly 40.

To overcome the shortcomings, the present invention provides a tent assembly to mitigate or obviate the aforementioned problems.

SUMMARY OF THE INVENTION

The main objective of the invention is to provide a tent assembly that can be constructed and deconstructed easily and can keep elastic belts from elastic fatigue.

The tent assembly has a supporting frame and a rainfly. The supporting frame has a top base and multiple supporting rod units pivotally connected to and spacedly arranged around the top base. Each supporting rod unit has a top rod, a first joint, a middle rod, and two hooks. The top rod has a first end and a second end, and the first end is connected with the top base. The first joint is connected with the second end of the top rod and has a first connecting rod, a second connecting rod, and a pivotal center. The first connecting rod is connected with the second end of the top rod. The middle rod is connected with the first joint. Each hook has a first end and a second end. The second ends of the hooks are respectively pivotally connected with the first connecting rod and the second connecting rod of the first joint at positions away from the pivotal center of the first joint. The rainfly is connected with the supporting frame and has multiple connection units connected with the supporting rod units. Each connection unit has multiple connection ropes and at least one elastic belt. The connection ropes are spacedly arranged and connected with the top rod and the middle rod of one of the supporting rod units. The at least one elastic belt is mounted around the first ends of the hooks of a corresponding one of the supporting rod units.

Other objectives, advantages and novel features of the invention will become more apparent from the following detailed description when taken in conjunction with the accompanying drawings.

DETAILED DESCRIPTION OF PREFERRED EMBODIMENTS

Figure 1:
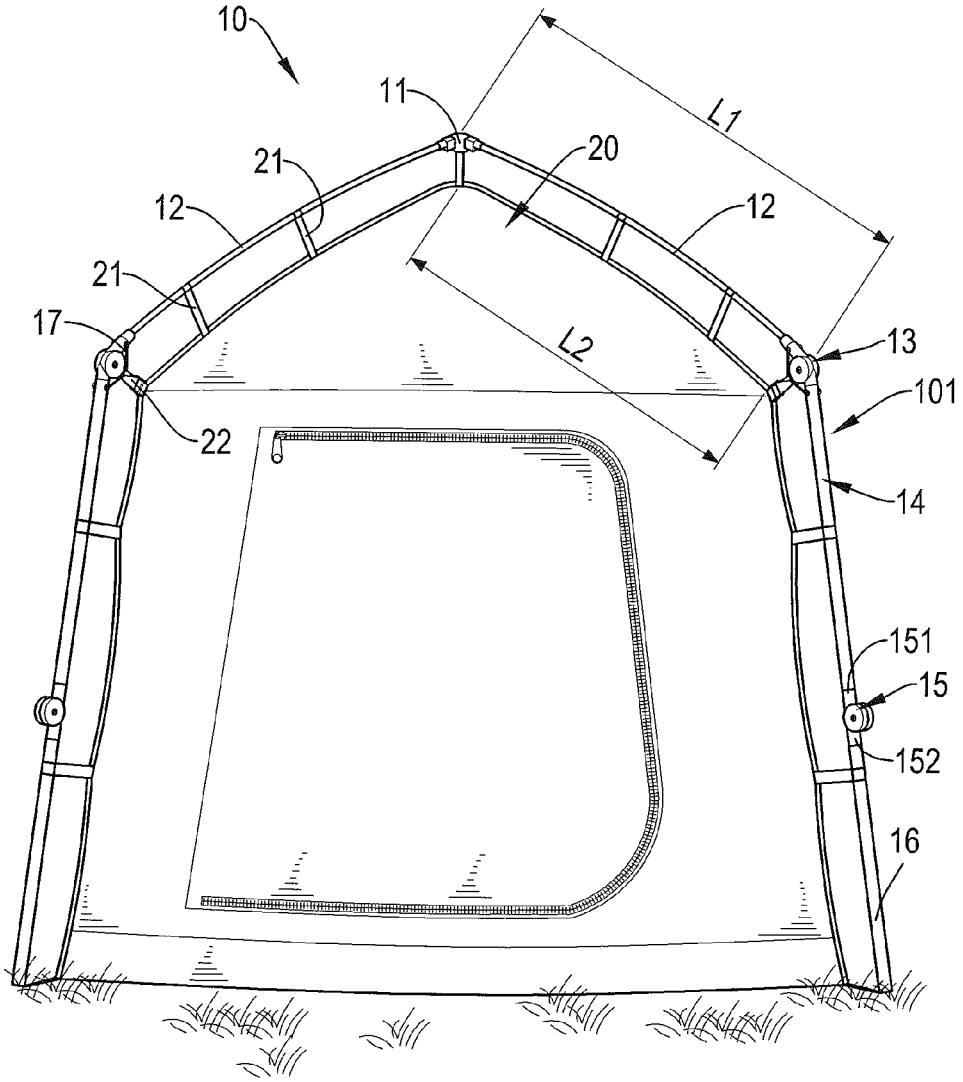
FIG. 1 is a side view of a tent assembly in accordance with the present invention.
Figure 2:
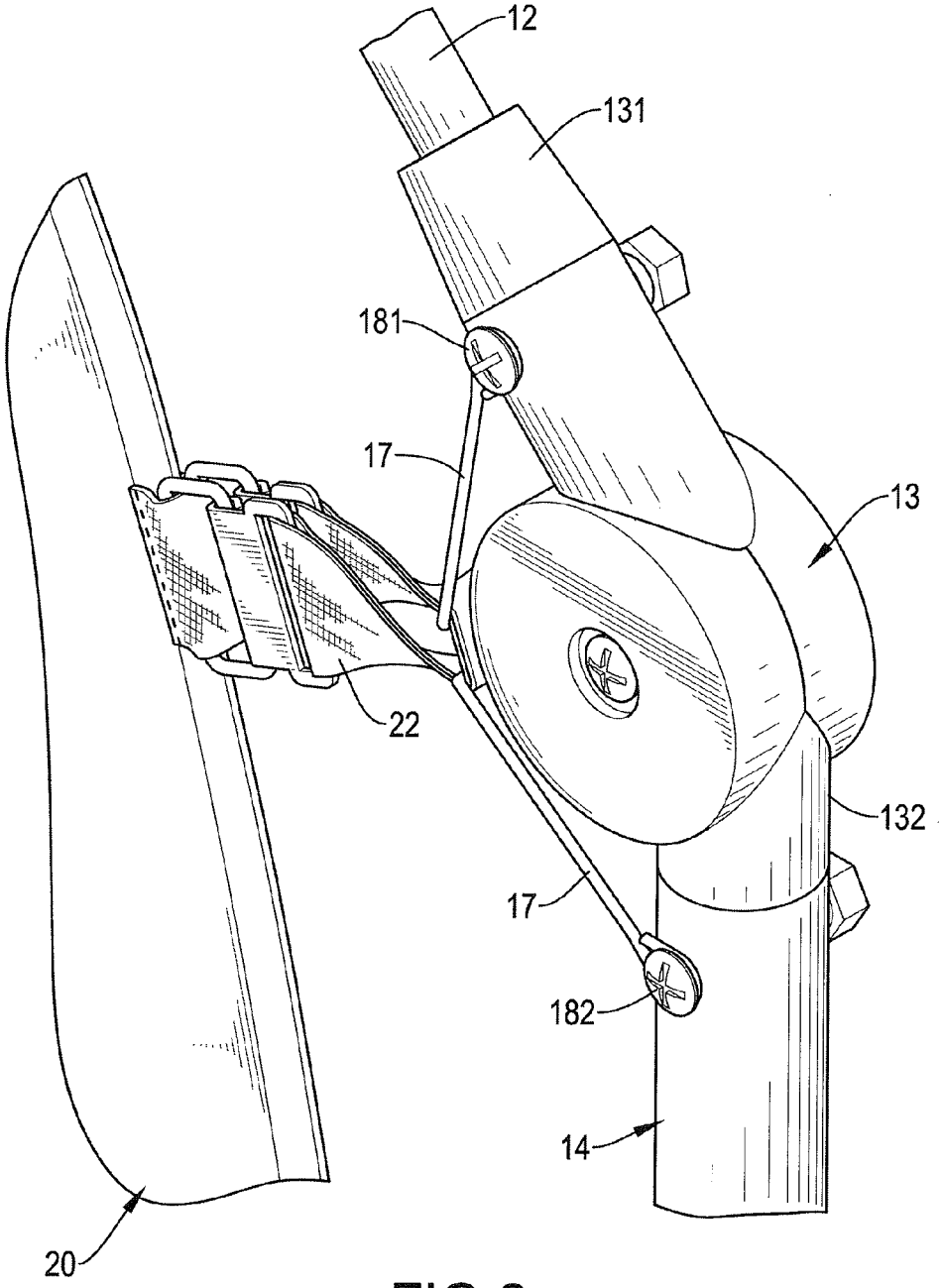
FIG. 2 is an enlarged perspective view of a first joint, a top rod, a middle rod, and two hooks of the tent assembly in FIG. 1.
Figure 3:
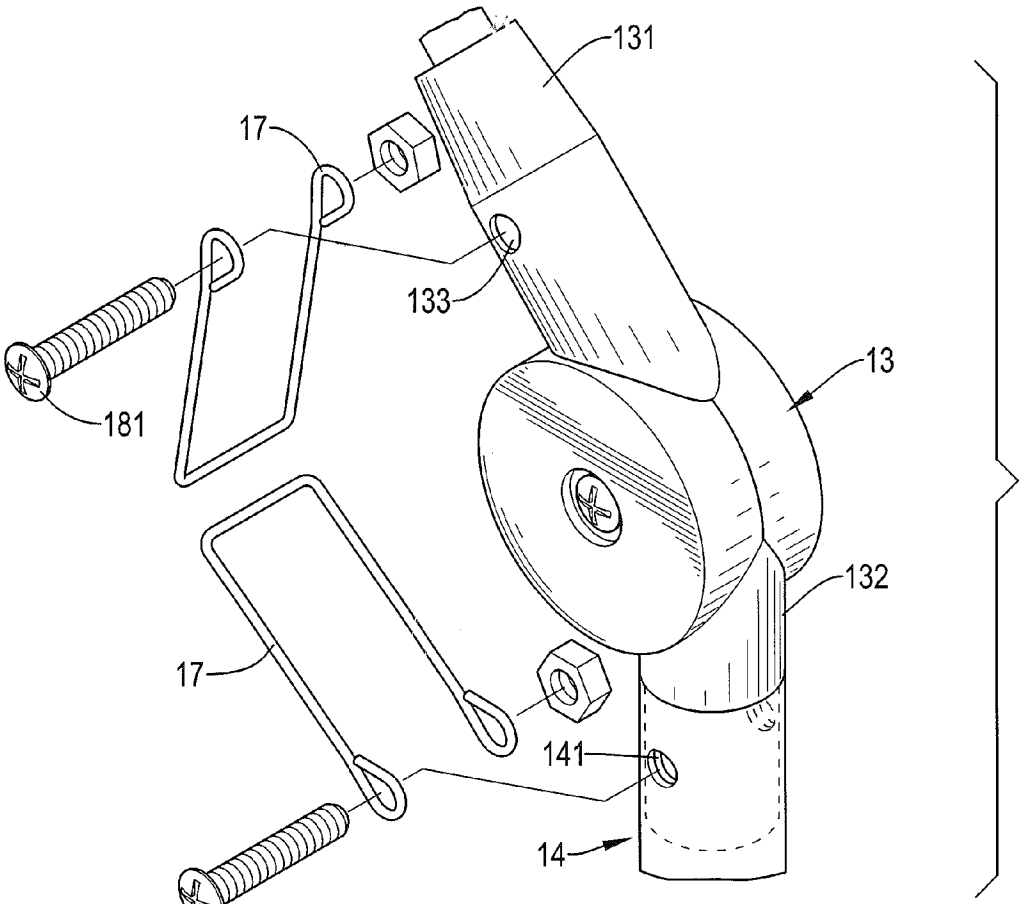
FIG. 3 is an exploded perspective view of the first joint, the top rod, the middle rod, the two hooks, and two elastic belts of the tent assembly in FIG. 2.

With reference to FIGS. 1 to 3, a tent assembly in accordance with the present invention comprises a supporting frame 10 and a rainfly 20.

The supporting frame 10 comprises a top base 11 and multiple supporting rod units 101. The top base 10 may be made of glass fiber. The supporting rod units 101 are pivotally connected to and spacedly arranged around the top base 10, and each supporting rod unit 101 comprises a top rod 12, a first joint 13, a middle rod 14, two hooks 17, a second joint 15, and a bottom rod 16. The top rod 12 has a first end and a second end, and the first end is connected with the top base 11. The first joint 13 is connected with the second end of the top rod 12 and has a first connecting rod 131, a second connecting rod 132, and a pivotal center C. The first connecting rod 131 and the second connecting rod 132 are pivotally connected with each other at the pivotal center C. The first connecting rod 131 is connected with the second end of the top rod 12. Preferably, the first connecting rod 131 is hollow and is mounted around the second end of the top rod 12. The first connecting rod 131 further has a first through hole 133 radially defined in the first connecting rod 131. A first pivot 181 is mounted through the first through hole 133 and the top rod 12.

The middle rod 14 is connected with the first joint 13 and preferably is connected with the second connecting rod 132 of the first joint 13. The middle rod 14 has a second through hole 141 radially defined in the middle rod 14. A second pivot 182 is mounted through the second through hole 141 and the second connecting rod 132.

Each of the hooks 17 has a first end and a second end. The second ends of the hooks 17 are respectively pivotally connected with the first connecting rod 131 and the second connecting rod 132 of the first joint 13 at positions away from the pivotal center C of the first joint 13. Preferably, the second ends of the hooks 17 are respectively mounted rotatably around the first pivot 181 and the second pivot 182.

The second joint 15 is connected with the second end of the middle rod 14 and has a first connecting rod 151 and a second connecting rod 152. The first connecting rod 151 is pivotally connected with the second connecting rod 152. The first connecting rod 151 is connected with and mounted around the second end of the middle rod 14. The bottom rod 16 is connected with the second connecting rod 152 of the second joint 15.

Figure 6:
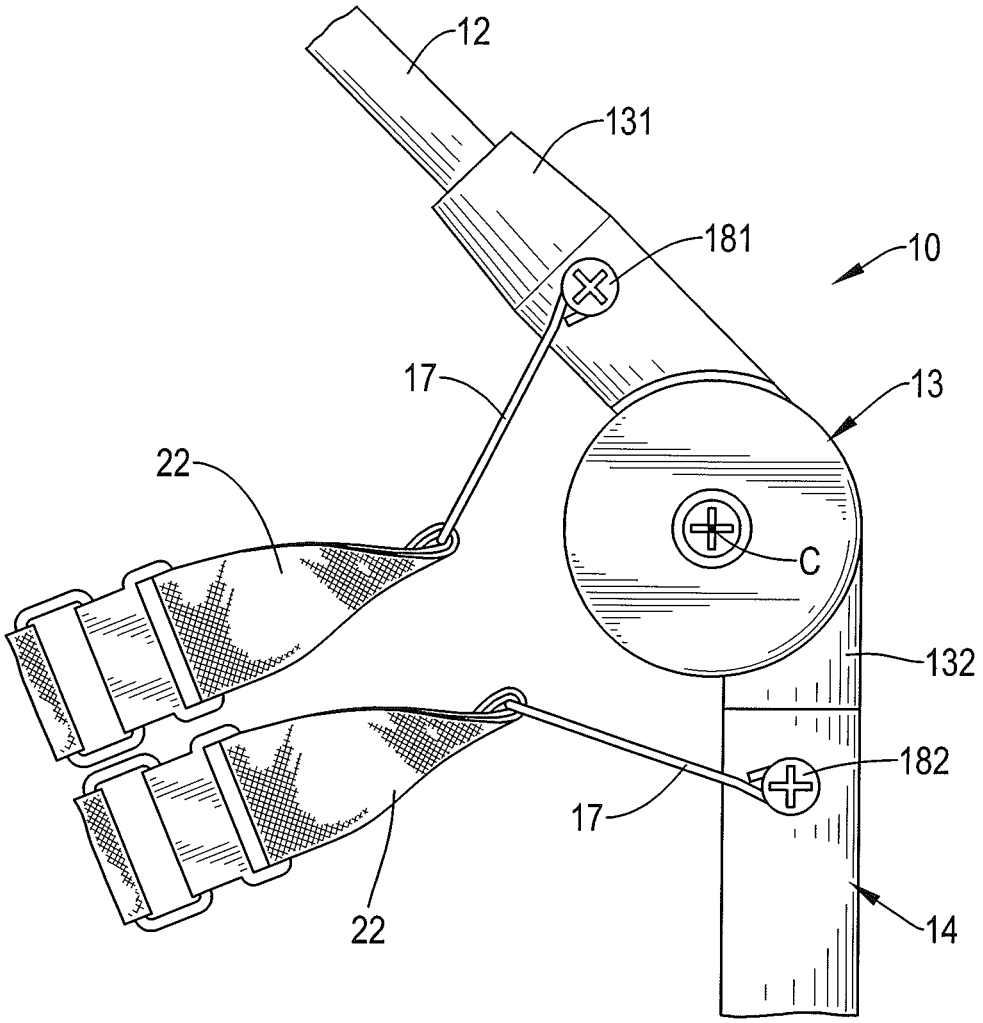
FIG. 6 is a perspective view of anther embodiment of a first joint, a top rod, a middle rod, two hooks, and two elastic belts of a tent assembly in accordance with the present invention.
Figure 7:
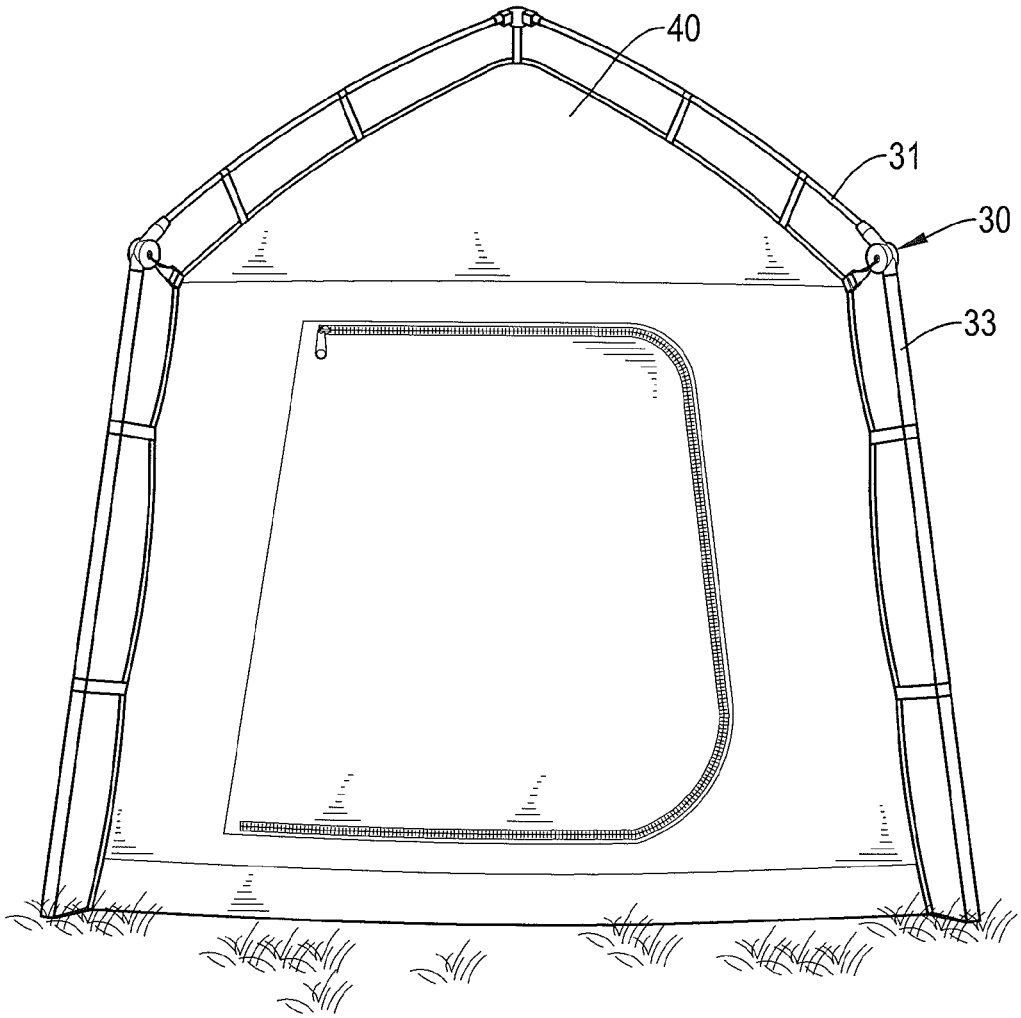
FIG.7 PRIOR ART
FIG. 7 is a side view of the conventional tent.
Figure 8:
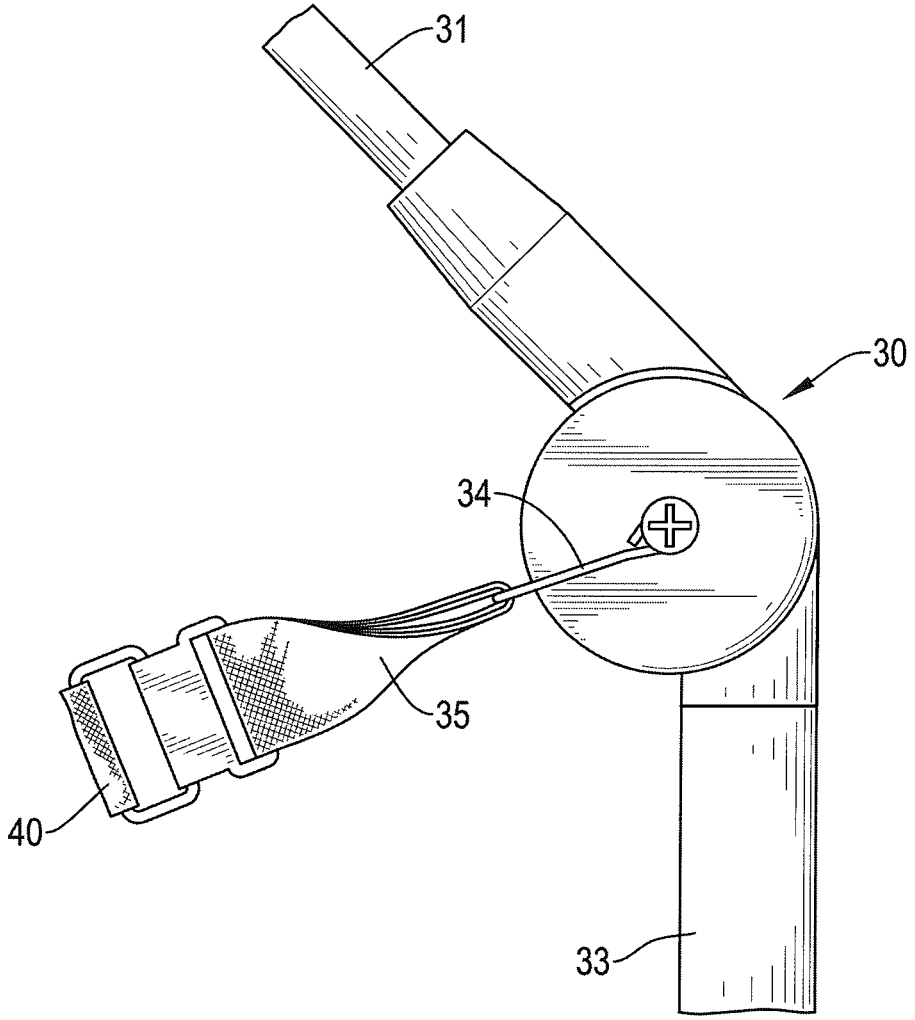
FIG.8 PRIOR ART
FIG. 8 is a side view of a first joint, a top rod, a middle rod, a hook, and an elastic belt of the tent assembly in FIG. 7.

With reference to FIGS. 1 and 2, the rainfly 20 is connected with the supporting frame 10 and comprises multiple connection units. The connection units are connected with the supporting rod units 101, and each connection unit comprises multiple connection ropes 21 and at least one elastic belt 22. The connection ropes 21 are spacedly arranged and connected with the top rod 12, the middle rod 14 and the bottom rod 16 of one of the supporting rod units 101. The at least one elastic belt 22 is mounted around the first ends of the hooks 17 of a corresponding one of the supporting rod units 101. In the present embodiment, one elastic belt 22 is implemented. Alternatively, with reference to FIG. 6, two elastic belts 22 are implemented, and the two elastic belts 22 are mounted respectively around the first ends of the hooks 17 of the corresponding supporting rod unit 101. In addition, each elastic belt 22 is formed as a loop.

With reference to FIG. 1, the top rod 12 of each supporting rod unit 101 has a length L1, and the rainfly 20 has a length L2 defined between two of the connection ropes 21 that are respectively connected to the top base 11 and the first joint 13 of one of the supporting rod units 101. The length L1 of the top rod 12 of each supporting rod unit 101 is longer than the length L2 of the rainfly 20. Preferably, the length L1 of the top rod 12 of each supporting rod unit 101 is 105% of the length L2 of the rainfly 20.

Figure 4:
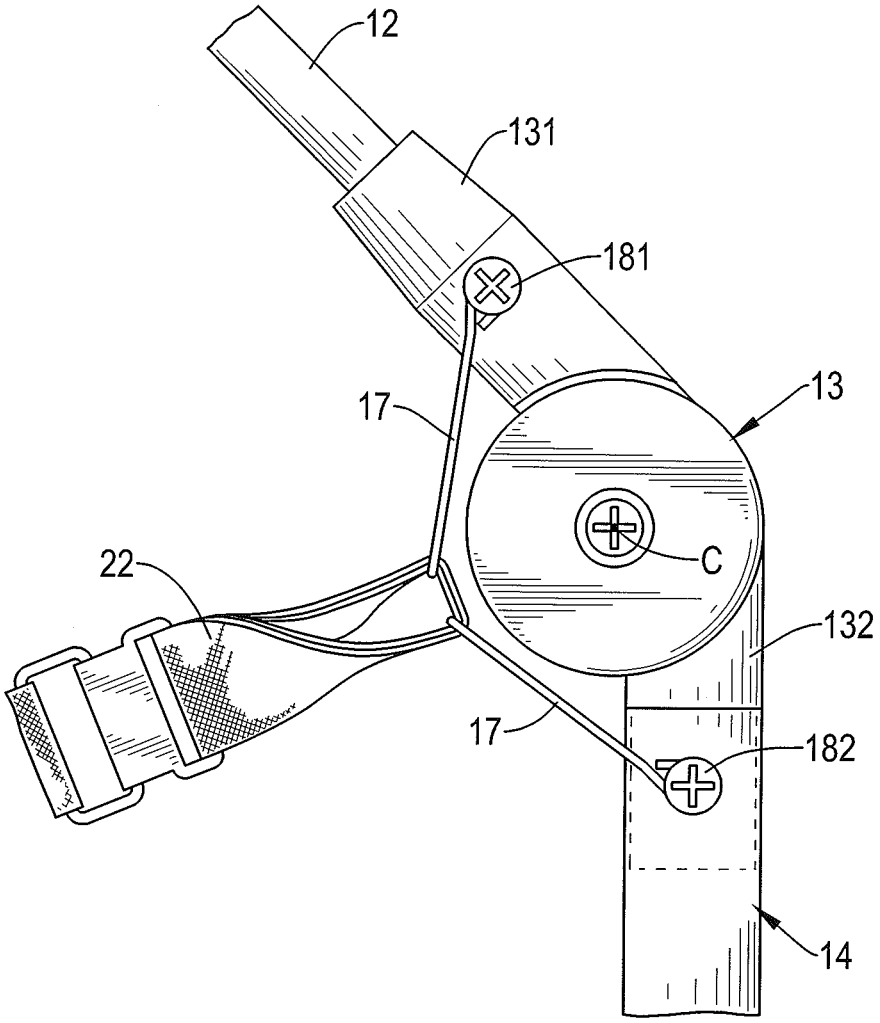
FIG. 4 is a side view of the first joint, the top rod, the middle rod, the hooks, and the elastic belts of the tent assembly in FIG. 2.
Figure 5:
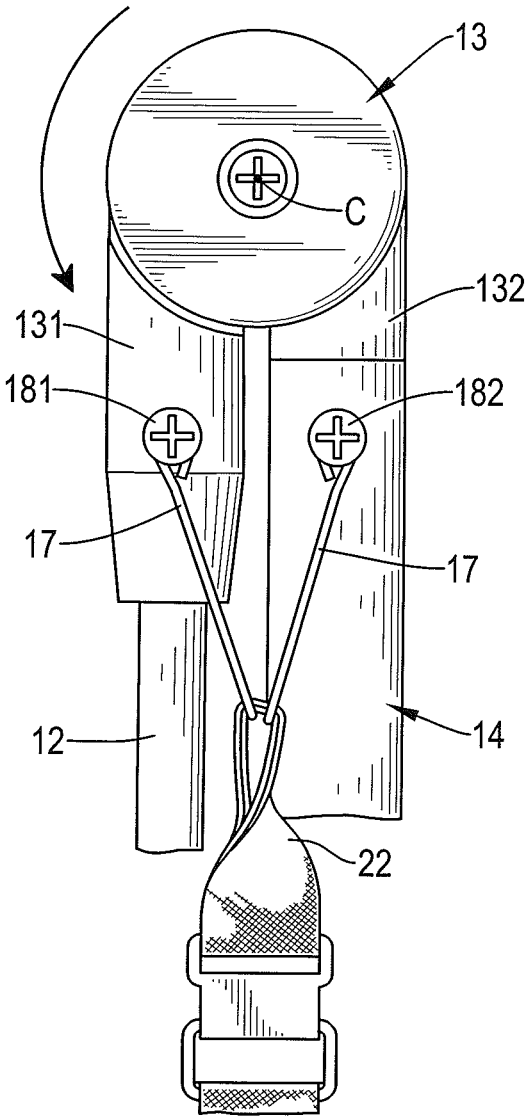
FIG. 5 is an operational side view of the first joint, the top rod, the middle rod, the hooks, and the elastic belts of the tent assembly in FIG. 2.

With reference to FIGS. 1, 4, and 5, to built up the tent assembly, the supporting rod units 101 are erected and expanded, and the rainfly 20 may be completely expanded and supported inside the supporting frame 10 by the elastic belts 22 and the connection ropes 21. Therefore, the tent assembly is easily constructed. The top rods 12 may be slightly curved between the top base 11 and the first joints 13, because the length L1 of the top rods 12 are longer than the length L2 of the rainfly 20. Consequently, the curved top rods 12 can provide an excellent supporting effect to the rainfly 20 to prevent the rainfly 20 from being collapsed. To disassemble the tent assembly, the top rods 12 and the middle rods 14 are pivoted inward relative to the rainfly 20 at the pivotal centers C of the first joints 13, such that the elastic belts 22 are loosened from the hooks 17. The bottom rods 16 and the middle rods 14 are then pivoted inward and relative to the second joints 15, such that the supporting frame 10 can be folded. Because the hooks 17 are pivotally connected with the first joints 13 at positions away from the pivotal centers C of the first joints 13, the distances between the pivotal center C of each first joint 13 and the connection positions between the corresponding hooks 17 and the elastic belts 22 will be prolonged. Accordingly, the elastic belts 22 can be effectively loosened and kept from being expanded, so the elastic belts 22 can be kept from elastic fatigue. Thus, the useful life of the elastic belts 22 can be efficiently prolonged.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A tent assembly comprising:

a supporting frame comprising:

a top base; and multiple supporting rod units pivotally connected to and spacedly arranged around the top base, with each supporting rod unit comprising:

a top rod having a first end and a second end, with the first end connected with the top base;

a first joint connected with the second end of the top rod and having:

a first connecting rod connected with the second end of the top rod;

a second connecting rod; and a pivotal center;

a middle rod connected with the first joint; and two hooks each having a first end and a second end, wherein the second ends of the two hooks are respectively pivotally connected with the first connecting rod and the second connecting rod of the first joint at positions away from the pivotal center of the first joint; and a rainfly connected with the supporting frame and comprising:

multiple connection units connected with the supporting rod units, with each connection unit comprising:

multiple connection ropes spacedly arranged and connected with the top rod and the middle rod of one of the multiple supporting rod units; and at least one elastic belt mounted around the first ends of the hooks of a corresponding one of the multiple supporting rod units, wherein:

the first joint of each supporting rod unit further has:

a first through hole radially defined in the first connecting rod of the first joint; and a first pivot mounted through the first through hole and the top rod connected with the first connecting rod of the first joint;

the middle rod of each supporting rod unit further has:

a second through hole radially defined in the middle rod; and a second pivot mounted through the second through hole and the second connecting rod of the first joint connected with the middle rod; and the second ends of the two hooks of each supporting rod unit are respectively mounted rotatably around the first pivot and the second pivot.

2. The tent assembly as claimed in claim 1, wherein:

the top rod of each supporting rod unit has a length;

the rainfly has a length defined between two of the multiple connection ropes that are respectively connected to the top base and the first joint of one of the multiple supporting rod units; and the length of the top rod of each supporting rod unit is longer than the length of the rainfly.

3. The tent assembly as claimed in claim 2, wherein the length of the top rod of each supporting rod unit is 105% of the length of the rainfly.

4. The tent assembly as claimed in claim 3, wherein:

the first connecting rod and the second connecting rod of the first joint of each supporting rod unit are pivotally connected with each other at the pivotal center;

the first connecting rod of the first joint of each supporting rod unit is mounted around the second end of the top rod of the supporting rod unit;

the middle rod of each supporting rod unit has a first end and a second end, with the first end of the middle rod connected with the second connecting rod of the first joint; and each supporting rod unit further comprises:

a second joint having:

a first connecting rod connected with and mounted around the second end of the middle rod; and a second connecting rod; and a bottom rod connected with the second connecting rod of the second joint.

5. The tent assembly as claimed in claim 4, wherein the at least one elastic belt of each connection unit is implemented as two in amount, and wherein the two elastic belts of each connection unit are mounted respectively around the first ends of the two hooks of the corresponding supporting rod unit.

6. The tent assembly as claimed in claim 5, wherein the top base of each supporting rod unit is made of glass fibers.

7. The tent assembly as claimed in claim 6, wherein each elastic belt is formed as a loop.

8. The tent assembly as claimed in claim 1, wherein:

the first connecting rod and the second connecting rod of the first joint of each supporting rod unit are pivotally connected with each other at the pivotal center;

the first connecting rod of the first joint of each supporting rod unit is mounted around the second end of the top rod of the supporting rod unit;

the middle rod of each supporting rod unit has a first end and a second end, with the first end of the middle rod connected with the second connecting rod of the first joint; and each supporting rod further comprises:

a second joint having:

a first connecting rod connected with and mounted around the second end of the middle rod; and a second connecting rod; and a bottom rod connected with the second connecting rod of the second joint.

9. The tent assembly as claimed in claim 1, wherein the at least one elastic belt of each connection unit is implemented as two in amount, and wherein the two elastic belts of each connection unit are mounted respectively around the first ends of the hooks of the corresponding supporting rod unit.

10. The tent assembly as claimed in claim 1, wherein the top base is made of glass fibers.

11. The tent assembly as claimed in claim 1, wherein each one of the at least one elastic belt of each connection unit is formed as a loop.

* * * * *